United States Patent [19]

Salisbury

[11] Patent Number: 4,880,234

[45] Date of Patent: Nov. 14, 1989

[54] TRAINING RACKET FOR PROPELLING BASEBALLS AND SOFTBALLS

[76] Inventor: William F. Salisbury, 264 East 700 South, Springville, Utah 84663

[21] Appl. No.: 220,464

[22] Filed: Jul. 18, 1988

Related U.S. Application Data

[63] Continuation of Ser. No. 579,343, Feb. 13, 1984, abandoned.

[51] Int. Cl.[4] ..... A63B 51/04; A63B 51/14

[52] U.S. Cl. ..... 273/73 L; 273/72 R; 273/26 B

[58] Field of Search ..... 273/73 R, 73 C, 73 D, 273/73 E, 73 G73 L, 169, DIG. 24, 76, 72 R, 67 R, 26 R, 26 B; 272/65; D21/212

[56] References Cited

U.S. PATENT DOCUMENTS

| | | | |
|---|---|---|---|
| D. 217,824 | 6/1970 | Carlton | 273/73 C X |
| 293,573 | 2/1884 | Greenough et al. | 273/73 D |
| 1,558,507 | 10/1925 | Ryder | 273/73 L |
| 2,610,056 | 9/1952 | Lovell | 273/73 D |
| 3,502,330 | 3/1970 | Cheftel . | |
| 3,507,494 | 4/1970 | Finkel . | |
| 3,515,386 | 6/1970 | Mason | 273/73 |
| 3,672,672 | 6/1972 | Rubin | 273/55 R X |
| 3,711,092 | 1/1973 | Hogue | 273/73 D X |
| 3,968,966 | 7/1976 | D'Aquanni | 273/73 D |
| 3,971,560 | 7/1976 | Panosh | 273/DIG. 24 X |
| 4,073,529 | 2/1978 | Ostrin | 273/DIG. 24 |
| 4,151,995 | 12/1979 | Weed | 273/73 C |
| 4,221,383 | 9/1980 | Cappelli | 273/73 C |
| 4,238,262 | 12/1980 | Fishel | 273/73 D X |
| 4,293,130 | 10/1981 | Beranek | 273/73 R |
| 4,352,495 | 10/1982 | Marchionda | 273/73 C |

FOREIGN PATENT DOCUMENTS

| | | |
|---|---|---|
| 21122 | 10/1901 | United Kingdom . |
| 2116920 | 10/1972 | Fed. Rep. of Germany . |
| 2373302 | 8/1978 | Fed. Rep. of Germany . |
| 2752624 | 5/1979 | Fed. Rep. of Germany . |

*Primary Examiner*—Edward M. Coven

*Attorney, Agent, or Firm*—Mallinckrodt & Mallinckrodt

[57] ABSTRACT

A training racket for propelling baseballs and softballs comprising an open frame having an elongate handle attached to and extending outwardly from an end of the frame and a net having a flexible perimeter smaller than the perimeter of the open frame held tautly within the frame by a plurality of individual adjustable stretch strips spaced about the frame and interconnecting the perimeter of the net with the frame. The individual stretch strips are elongate strips of resilient material having an opening near one end through which the opposite end is passed to create a loop about the perimeter of the net and the racket frame with the ends of the strips at the outside of the frame. The strips are turned over so that the ends of the strips are sandwiched between the racket frame and intermediate portions of the strips and are thereby held in adjusted loop formation.

19 Claims, 3 Drawing Sheets

TRAINING RACKET FOR PROPELLING BASEBALLS AND SOFTBALLS

RELATED APPLICATIONS

This application is a continuation of application Ser. No. 579,343, now abandoned, filed Feb. 13, 1984.

BACKGROUND OF THE INVENTION

1. Field of the Invention

This invention relates to a racket for propelling balls. More particularly, the invention relates to a training racket for propelling baseballs and softballs having special features which permit efficient and effective training of personnel.

Specifically, the invention provides a new and different training racket which provides an easy method to effectively and efficiently hit a better quality and quantity of fly and ground balls (baseballs and softballs) in post and pre game drills and practice sessions for team members and individuals. The new racket comprises an open frame having a beveled weighted portion at one end and an elongated handle attached close to the opposite end of said frame, and having a detachable net having a flexible perimeter smaller than the perimeter of the open frame tautly held within the interior of the frame by a series of self-holding and individually adjustable strips interconnecting the perimeter of the net with the said frame.

2. Prior Art

The disadvantages of utilizing a conventional baseball or softball bat for fielding practice is well detailed in U.S. Pat. No. 3,048,399. This patent proposes a partial solution to the conventional bat problem by utilizing a field practicing bat consisting of a solid handle portion and an innerconnected loop portion having a springy membrane contained with the loop portion. The membrane is made of rubber or similar material which is relatively thin so as to be readily stretched. When the practice bat is swung and the ball comes in contact with the bat, the membrane will be stretched keeping the ball in contact with the membrane for a relatively long period of time thereby allowing greater control and placement of the ball. This is disadvantageous in that, in order to properly train either infielders or outfielders, it is essential that the fielder practices timing to begin with the "crack-of-the bat". In other words, the deflection or hit of the ball in the opposite direction should coincide closely as possible with the swinging of the bat. If such is not the case, a fielder may lose his sense of timing, and fielding mistakes may be the result thereof. Moreover, when a ball strikes a thin stretchable surface, there is little or no opportunity to simulate the actual conditions that occur when a ball is hit by a conventional bat. Such phenomena as slicing the ball or putting a spin on the ball are difficult, if not impossible, to accomplish with the structure claimed in the above-mentioned patent. Also, the forcing of a ball directly into or against a thin stretchable surface causes considerable stress and weakening of that surface at the point of contact instead of evenly distributing the forces throughout the surface of the contact surface.

An additional disadvantage found in a structure such as claimed in U.S. Pat. No. 3,048,399 is that one cannot see through the surface of the looped portion of the bat in order to accurately tell which portion of the bat has come in contact with the ball prior to the ball hitting the bat. Also, the face of such a bat having a large surface area encounters considerable wind resistance which not only can affect the speed at which the bat is swung, but also the control in placing the ball in the desired position. Moreover, such resistance can place considerable strain on the arm, elbow and shoulder of the user.

It is, therefore, an object of the present invention to provide a device for the propelling of game balls, and non-deformable balls in particular, whereby such balls are propelled almost immediately upon impact and wherein the placement of said balls so propelled can be accurately determined by the user of the device.

It is also an object of the present invention to provide a device for the accurate propelling of game balls wherein there is little or no wind resistance to the device thereby allowing better placement of the ball and reducing arm strain on the part of the user.

Still another object of the present invention is to provide a ball propelling device wherein the ball is propelled immediately upon impact and can be accurately placed while at the same time providing a spinning, cutting, or slicing action to the ball as is accomplished with conventional bats.

A still further object of the inventions is to provide a ballpropelling device, particularly for hard balls, which allows the user to see through the hitting area of the device, thereby determining which area the ball comes in contact with the device.

Another object of the invention is to provide a training racket which permits individual adjustment of the net tension so as to better control distance, height and velocity of the ball.

Another object is to provide a training racket for propelling balls which permits delivery of maximum power with minimum effort by special designation of "sweet spots" and "power zones" in the net area.

Another object of the present invention is to provide training rackets for propelling balls which emphasizes follow through in the swing and improve distance and accuracy.

A still further object of the invention is to provide a new training racket for propelling balls which enables the fielder to pick the ball up off the face of the racket and improve his eye-body reflex and coordination in getting a jump in fielding the fly balls.

A still further object of the invention is to provide new training rackets which provides an easy, safe and convenient way to pick up balls returned to the racket user.

SUMMARY OF THE INVENTION

It has now been discovered that these and other objects can be accomplished by the new training rackets of the present invention comprising an open frame having a beveled weighted portion at one end and an elongated handle attached close to the opposite end of said frame, and having a detachable net having a flexible perimeter smaller than the perimeter of the open frame tautly held within the interior of the frame by a series of self-holding and individually adjustable strips interconnecting the perimeter of the net with the said frame. The size and shape of the open frame may vary as may the size and shape of the net suspended therein. The net, being tightly stretched within the open frame, provides a relatively stable surface when it comes into contact with a ball which is to be propelled. While there is some deformity or resilience in the net, the springlike or resilient bands connecting the net to the frame provide a springing force for propelling the ball away from the net. In other words, a trampoline type of effect is created and the contact time of the ball with the net is minimized, thereby allowing the ball to be propelled away from the net almost at the instant of contact.

By use of the present invention, a ball can be propelled high into the air as a pop fly, infield or outfield. The ball can also be hit as a line drive. More importantly, the ball can be propelled along the ground at various speeds and can be cut, sliced or spun while being propelled to simulate actual conditions occurring when the ball is propelled from a conventional bat.

The open nature of the hitting surface substantially eliminates wind resistance or surface draft and also makes it possible for a hitter to see which portion of the net the ball comes in contact with.

The special self-holding individually adjustable stretch strips which attaches the net to the frame allows the user to set the net tension to his own individual needs. For example, the taut net is best for distance, height and velocity while the loose net is better for control and accuracy. Furthermore, such adjustment eliminates racket damping vibrations both vertical and torque, which in turn eliminates any vibration or strain on the user's hand, wrist, forearm, elbow and shoulder, also upper and lower back.

In addition, the new rackets of the present invention with the handle purposely packed closer to the "sweet spot" and "power zone" hitting areas give improved distance and velocity, the "sweet-spot" being the place on the racket where there is no vibration, and maximum distance and control are generated. The rackets of the present invention are designed to take advantage of the "sweet-spot" and "power zone" with the broad, even design of the racket face, the ability to regulate and set the tension on the self-holding adjustable stretch strips, and the placement of the handle close to the said "power zone" and "sweet-spot". The new rackets with the see through net with different colors in or on the net surface to designate the "sweet spot" and "power zone" also provides a better opportunity for the user to place the ball within these special areas.

The special feature of also having the weighted, beveled, colored rim on the face of the racket also provides additional advantages. The weighted rim provides emphasis in hitting through the ball and follow through in hitting (baseballs and softballs) in the desired swing and arc to improve both distance and accuracy. The colored rim enables the fielder to pick the ball up off the face of the racket more easily and improved his eye-body reflex and coordination in getting a jump on the flyballs and ground balls through continuous practice of watching the ball coming off the noiseless net.

The beveled edge of the racket provides an easy, safe, convenient way to pick up balls returned to the racket user, either thrown, bounced or rolled.

Further advantage is also found in the fact that the new training rackets of the present invention creates no noise when the ball is struck by the user. This provides special training and conditioning for the fielder because, as he is no longer able to hear the ball being struck and must rely solely on following the trajectory of the ball. This improves and sharpens the ability to pick up the flight of the ball off the face of the noiseless net. Consequently, by continuously practicing and picking up the flight or ground trajectory of the ball, the fielder greatly improves his fielding ability of all types of fly and ground balls.

DETAILED DESCRIPTION OF THE INVENTION

Figure 1:
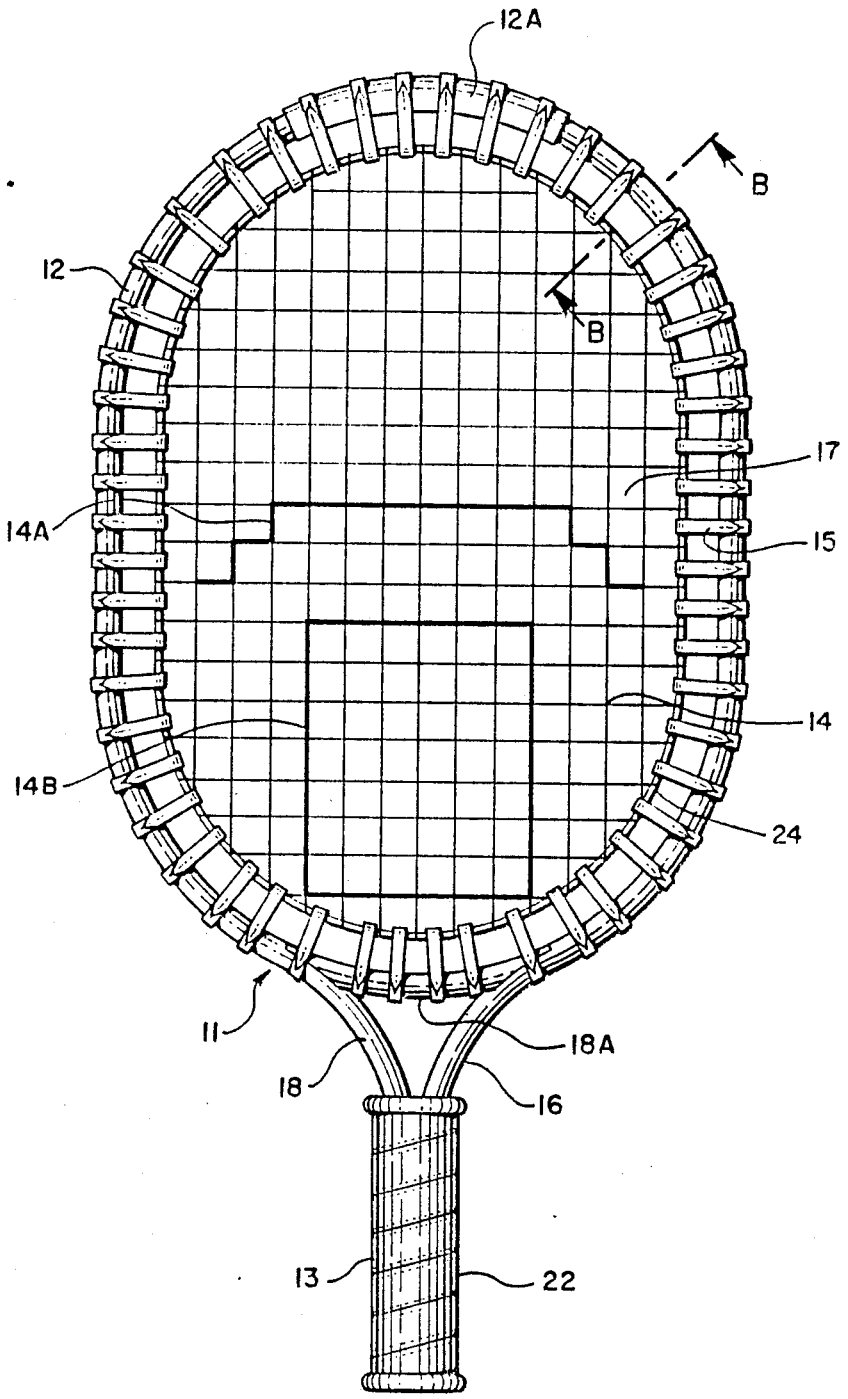
FIG. 1 is a perspective view of a racket comprising one embodiment of the invention having an oval open frame wherein the handle is very close to the rim of the frame, the top of the rim is beveled and weighted, and the "sweet-spot" and the "power zone" are marked on the net.

The new training rackets of the present invention comprise an open frame having a beveled weighted portion at one end and an elongated handle attached close to the opposite end of said frame, and having a detachable net having a flexible perimeter smaller than the perimeter of the open frame tautly held within the interior of the frame by a series of self-holding and individually adjustable strips interconnecting the primeter of the net with the said frame.

The preferred embodiments of the invention are shown in FIGS. 1 to 4. These figures illustrate the open frame 12 which has the beveled weighted portion at the top end 12A, and is attached to the handle 13. Net 14 is suspended within the open frame and is attached to the frame by means of the self-holding adjustable strips 15. The net is marked with the "sweet-spot" zone 14B and the "power zone" 14A.

The handle 13 and open frame 12 can be an integral unit or separately formed. The open frame can be formed in any useful geometric shape. For example, the open frame can be oval, round, square, rectangular or any other polygonal shape. The handle 13 is attached very close to the frame, e.g. not more than 3 inches removed therefrom. The handle itself is preferably shorter than the diameter of the open frame and may have a wrapping or may be shaped as a baseball bat handle. The handle may be bent such that the plane of the open frame is different from but parallel to the plane of the handle. Fingergrips may be placed on the handle to indicate positioning or allow better gripping. The handle may be adjustable or replaceable, and may be hollow for storage of other nets or valuables.

The handle and frame may be constructed of any suitable material. This includes, for example, plastics with various strengthening and stiffening materials, i.e. graphite, glass fibers, etc. They can also be made of steel or aluminum, or any alloys thereof. The handle and frame can also be made of wood, either solid one pice construction or a combination of woods laminated, including bamboo wood, or any combination thereof or with any of the aforementioned materials, such as plastic, wood, etc. The tubing for the handle and frame can be of any shape, such as round, oval, square, flat or angled in shape. As noted above, the frame is beveled at the top end to permit rapid retrieval of the balls.

The net 14 may be of the same shape as the open frame or different. For example, an oval frame could have suspended therein an oval, square, octagonal, round or any other shaped net. The net may be of any suitable material such a catgut, extruded plastic or metal strings or may be a woven fiber such as wool, cotton, nylon, polyester or a combination thereof. The shape of the openings 17 in the net 14 may vary in size and shape and also in the manner in which they are formed. For example, the openings may be square, round, triangular, rectangular, or any other polygonal shape and may be formed by crisscrossing, weaving, crocheting, knotting and the like.

Moreover, the net apertures 17, may be of a uniform or varying size. For example, it may be beneficial to have smaller apertures at the center thereof or vice versa depending on the desired effect.

The flexibility of the net will depend upon the materials used and how tightly they are connected together. A crocheted string interwoven into a net will have greater flexibility than a tightly strung, criss-crossed, extruded nylon string. The tautness of the net within the frame will also affect its flexibility.

The size of the net may also vary with a minimum area just large enough to contact the desired size ball to a maximum area that is just slightly smaller than the area defined by the open frame. Preferably the net will give a diameter that is about ½ to 9/10 of the shortest diameter of the open frame with diameters of 3/5 to 4/5 being especially preferred.

The net may be of a uniform color or it may contain colored designs or markings to show the optimal place to contact the ball with the net to accomplish the desired results. As noted above, the net can be marked to show the "sweet-spot" and "power zone" to enable the user to hit a long fly ball, ground ball, line ball, pop fly etc. with greater accuracy. In FIG. 1, the "sweet-spot" is illustrated by line 14B and the "power zone"by line 14A.

Figure 10:
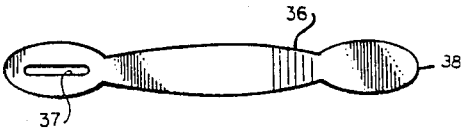
FIG. 10 illustrates the special self-holding adjustable strips to be used to connect the net to the frame.

The net is to be connected to the frame by use of a special self-holding individually adjustable stretch strip as illustrated by FIG. 10. This stretch strip is to be made of rubber or any stretch material or combination of stretch materials capable of providing desired propelling or trampoline action, and additives to inhibit deterioration from elements in the ozone or other natural elements.

The size of the stretch strip can vary over a wide range, e.g from an inch wide down to any portion of an inch thereof to meet the needs. The length can be anywhere from one foot graduated down to any portion of an inch thereof.

Figure 11:
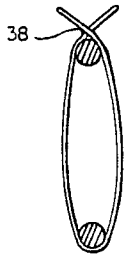
FIGS. 11 and 12 illustrate how the strips can be used to make such an attachment.
Figure 12:
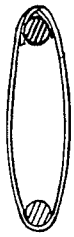

The stretch strip can be of any desired shape, but is preferably one having a shape from T shape to modified tear drop, or modified triangle. The shape may also be hexagon and octagon, or any portion of the above shapes. One end (distal) will have a hole or slit. The end opposite the distal or hole end is threaded through the hole or slit so that the stretch strip forms a loop. The ends are then adjusted as to tension needed or wanted in the racket. These ends may be marked with indentations or graduated marks (similar to a ruler) on the stretch strips, as to more accurately mark each strip around the perimeter of the racket. This is needed to set or "tune" the racket to meet the individual user's needs, wants or desires. The assembly of the stretch strip on the net and frame is illustrated in FIGS. 11 and 12. When the self holding individually adjustable stretch strip meets the individuals desired tension on the net of the racket, the stretch strip is then inverted or turned over (flipped) so that the ends of the stretch strip are held by its own regulated or set tension. The set tension is provided by the rim of the racket and the net. In propelling the ball, with graduated indentations or marks on the distal or top end of the self-holding stretch strips, the user may easily set or tune the racket to meet his individual needs, such as in tuning the spokes on a bicycle wheel. Thus, for example, one may want to have the strips tight on the top and bottom of the racket, but loose on the sides.

As a preferred modification, a protective plastic clip may be placed over the stretch strip to protect the strip if the ball hits the strip against the rim of the racket. The self-holding adjustable stretch strips can also have snaps on each end, or have VELCRO on each end to hold the ends down.

The stretch strips can also be colored not only to protect them from the ozone, sunlight and impurities in the atmosphere but also to aid in visual perception and the ability to pick the ball up as it comes noiselessly off the racket. The strips can be fluorescent yellow or orange to more easily follow the swing of the racket as the ball is propelled off the noiseless net.

As noted above, weights are placed in the top end of the racket to aid in bringing about the superior properties of the said rackets. The weights are preferably located at the top beveled rim of the face of the racket. The weights are to be incorporated in the racket structure and preferably become a permanent part of the racket. The weight's primary function is to aid in hitting through the ball and provide emphasis to the swing or stroke of the racket. In addition, the weights also provide the user with greater distance and acccuracy on fly balls and greater speed and accuracy on ground balls. A secondary advantage of the weights would be in the assistance in loosening and stretching of the muscles, tendons, and ligaments of the wrist and forearm prior to the use of the racket.

The weights can be varied according to the need of the user. Thus, weights in the form of BB shots or other metal particles can be added or removed from the top of the rim as needed. The weights may vary preferably from about 5 oz to about 2 lbs according to the need of the user. The weights may be rigidly held in the rim or they may be contained in a hollow container which allows them to shift back and forth with the swing of the racket, thus aiding the use of the racket.

It should be noted that the weights employed in the present rackets are quite different from those added to the end of conventional baseball bats during warm up periods in that in this case the weights stay on the racket and aid in propelling the racket against the ball. In this manner, the weight is a permanent part of the racket and not a temporary add on.

Figure 7:
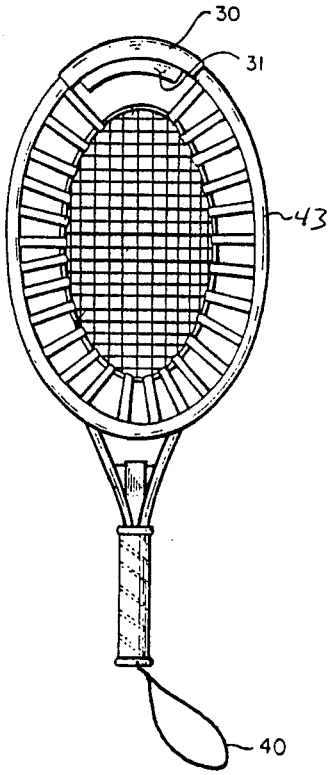
FIG. 7 is a perspective view of a racket showing the presence of added weights at the end of the racket rim and the presence of a lanyard to insure safety and a sure grip on the racket.

The weights may be located in the top end of the racket as shown by section 12A in FIG. 1, and 30 in FIG. 7. They may also be contained in an added hollow section 31 as shown in FIG. 7. The weights themselves (42 in FIG. 9) can be free to move about with the move of the racket.

Figure 8:
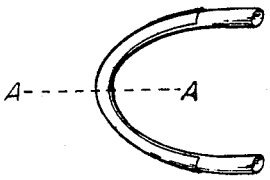
FIG. 8 is a perspective view of the top of the racket frame showing how it is beveled.
Figure 9:
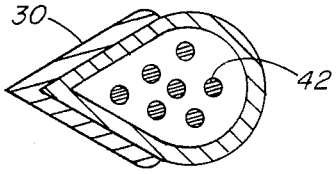
FIG. 9 is a cross-section along line A of FIG. 8 showing the beveling of the frame and the metal shots in the center for weight.

The top edge of the rim is preferably beveled as shown in FIG. 8 and FIG. 9. This is primarily to assist in recovery of the balls that have been thrown back to the user for reuse in practice. The beveling can be at any desired angle or length as long as it provides the necessary recovery feature. In general, the beveling is for about 2 to 4 inches at the top rim of the racket, and is preferably at an angle of about 45 degrees.

Figure 6:
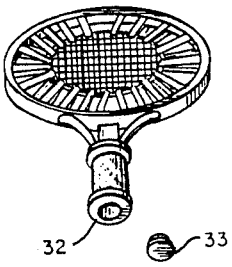
FIG. 6 is an end view of a racket showing the presence of a hollow handle.

The handle is placed close to the frame holding the net and is preferably hollow. This reduces the weight in the area below the face of the racket which aids greatly in the use of the racket. As noted, the handle can be used to hold or store extra nets, self-holding strips, valuables and the like. The end of the handle can be removable butt plate which acts to hold the stored materials during the use of the racket. The hollow handle is shown in FIG. 6 (item 32) with the butt plate shown as 33.

Figure 5:
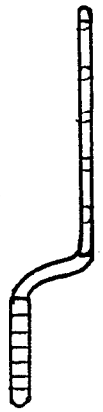
FIG. 5 is a side view of a racket showing the presence of a curved handle to aid in increasing power.

The handle can also be curved as shown in FIG. 5. This makes possible generating maximum force with minimum effort. This special feature also provides better controlled distance and accuracy on trajectory of balls hit in the air or on the ground.

A lanyard can be attached to the handle of the new rackets to insure safety and a sure grip on the racket handle. Such lanyards are shown in FIG. 7, item 40.

As a further embodiment of the present invention, one may also attach a second net to the frame by means of the new adjustable stretch strips. This embodiment provides a greater ball propelling force and minimizes the displacement that can occur in a single net by providing a backstop which resists further displacement.

With the above description in mind, the specific embodiments as shown in the drawings will now be described as showing a complete functional embodiment of the invention. However, this description is not to be self limiting of the scope of the invention as a whole.

FIG. 1 shows a preferred embodiment with racket 11 having a round open frame 12, and interconnecting throat 16 and handle 13. The complete outer structure of the handle, throat and frame is constructed of a single piece of tubular metal material 18 which is bent or otherwise formed into the proper shape. A handle grip 22 is forced tightly onto the ends of tubular frame 18. The handle is preferably not more than $2\frac{1}{2}$ to 3 inches removed from the said frame. The oval part of the frame formed as above is completed by welding a part 18A at the point where the frame is bent to form the handle.

The top end of the frame 12A is for a distance of about 4 inches beveled at an angle of 45 degrees and contains metal BB shots within the frame in a closed section to add weight to that end of the racket.

The net 14 consists of interwoven polyester strands forming substantially square apertures of approximately $\frac{5}{8}$ in diameter secured around the outer perimeter by a selvage or binding 24. The diameter of the net is about $\frac{3}{4}$ of the diameter of the open frame. The net 14 is secured to frame 12 by a series of resilient rubber self-holding individually adjustable strips 15 looped through the loops of the net directly or a binding 24, and attached to the rim of the frame as shown in FIG. 12.

The self-holding individually adjustable strips are best illustrated in FIG. 10. The rubber strip as shown in that Figure has an opening 37 through which the other end is threaded as in FIG. 11 and then pulled through and the assembly flipped over so as to hold the end of the strip against the rim. The strip is marked as shown by 36 so that the tension can be adjusted properly to the needs of the user.

The net 14 can be marked with different shapes to designate desired zones. for example, line 14A may be used to mark the power zone and line 14B to designate the "sweet-spot".

Figure 2:
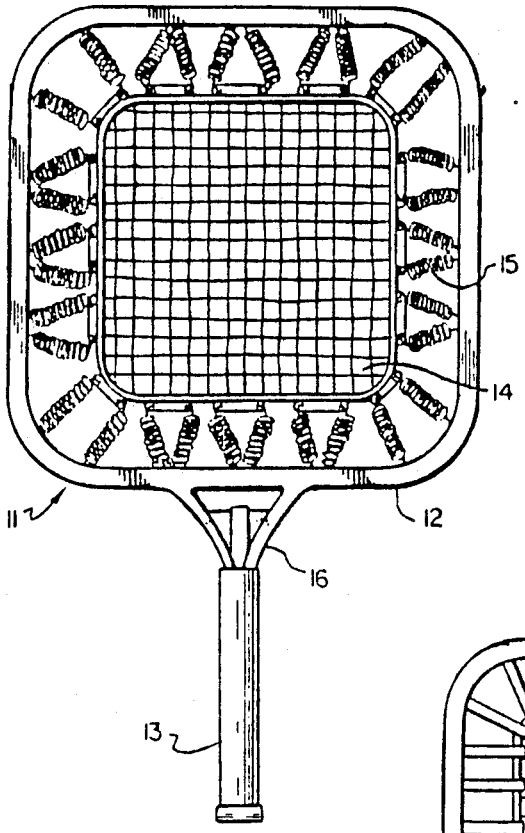
FIGS. 2, 3 and 4 are perspective view of different embodiments of the invention wherein the frame has a variety of shapes.
Figure 4:
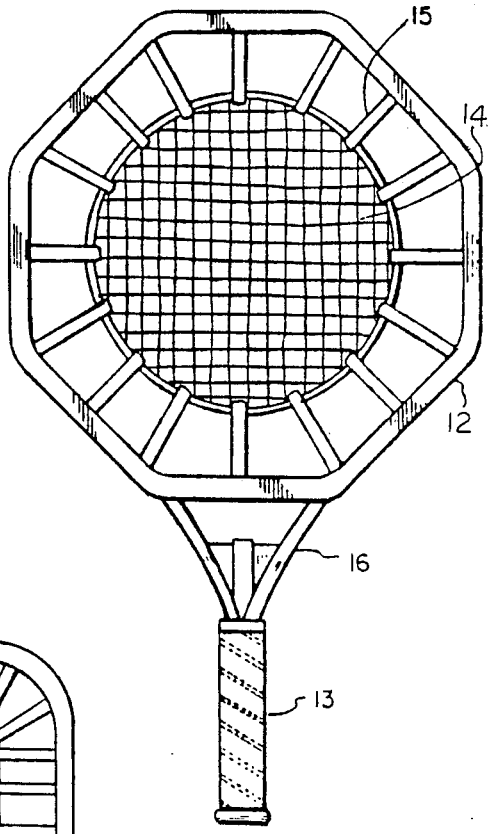
Figure 3:
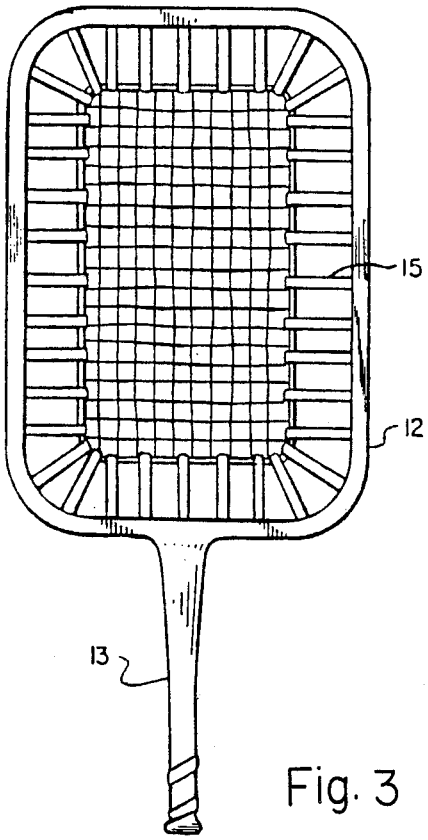

FIGS. 2 to 4 illustrate rackets as described above having different shapes to the frame and net. FIG. 2 shows a racket having a generally square open frame 12 and net 14. FIG. 4 shows a racket having an octagonal open frame 12 having suspended therein a round net 14. A contrasting racket is shown in FIG. 3. In this case, the open frame 12 and net 14 are rectangularly shaped to facilitate swinging as a conventional bat.

FIG. 6 illustrates a racket as defined above having a hollow handle with opening 32 and removable butt plate 33. FIG. 7 illustrates a racket similar to that shown in FIG. 1 with the exception that the weights are contained in a tube 31 attached to the outside of the frame and a protective cover 30 is added to beveled edge of the frame. A lanyard 40 is added to the bottom of the handle to insure safety and insure grip on the racket handle.

FIG. 8 illustrates the beveled nature of the top end of the frame and FIG. 9 is a cross-section through line A—A of FIG. 8 showing the beveled nature of the rim and the presence of the BB shots 42 inside the beveled rim is shown in FIG. 9.

FIG. 11 and FIG. 12 are cross-sectional views along line B—B of FIG. 1 showing the attachement of the stretch strips to the nets outer binding 24 and the rim 12. The strip is placed around the binding and the rim with ends 38 and 37 over the rim. The end 38 is then placed through the hole 37 and pulled to the proper tension. The ends are then turned under and the strip flipped over and the ends are held underneath and against the rim as shown in FIG. 12.

To protect the self-adjusting strips from the weather, one may place a plastic cover, such as item 43 as shown in FIG. 7 over the part of the strips as they go over the rim.

The new training rackets of the present invention can be used for a variety of purposes. They are chiefly intended for use in the training of players for softball and hard ball with the many advantages as described hereinabove. However, they are not limited to this use but may be utilized in other fields where training and development of certain muscles are needed.

A different but related invention comprises the use of self-holding individually adjustable springs to interconnect the perimeter of the net with the frame.

The above-described embodiments are exemplary only and modifications can be made without departing from the scope of the present invention which is to be limited only by the appended claims.

I claim:

1. A racket for propelling baseballs and softballs comprising an open frame having an elongate handle attached to and extending outwardly from an end of said frame, a detachable net having a flexible perimeter smaller than the perimeter of the open frame; a plurality of self-holding, individually adjustable stretch strips spaced about the frame and interconnecting the perimeter of the net with the frame to thereby hold the net tautly within the frame, each of said stretch strips being an elongate strip of resilient material having an opening near one end and each of said strips being looped about the perimeter of the net with ends extending to the outside of said frame with the end of the strip opposite the end with the opening passed through the opening and with the strips positioned such that the ends of the strips are held between the frame and intermediate portions of the strips to thereby hold the strips in looped formation.

2. A racket according to claim 1, wherein the length of the elongate handle is less than the shortest diameter of the open frame.

3. A racket according to claim 1, wherein each stretch strip is an elongate resilient strip having an opening near one end which becomes an elongate slot when said strip is stretched lengthwise.

4. A racket according to claim 3, wherein the largest diameter of the opening, in the unstretched state, is less than the width of the stretch strip.

5. A racket according to claim 1, wherein the stretch strips include one or more pair of opposing edge indentations near the end of the strip opposite the end having the opening.

6. A racket according to claim 1, wherein the stretch strips include graduated marks at the end opposite the opening whereby the graduations are visible as the end of the strip is drawn through the opening to provide an indication of tension on the strips.

7. A racket according to claim 1, wherein the net is fashioned of a crocheted string interwoven into a net.

8. A racket according to claim 1, wherein the handle is hollow.

9. A racket according to claim 1, wherein the open frame is in the form of a tear drop.

10. A racket according to claim 1, wherein the net has a diameter that is within a range of 3/5 to 4/5 of the shortest diameter of the open frame.

11. A racket according to claim 1, wherein the net and open frame have the same general shape.

12. A racket according to claim 1, wherein the frame is oval within the longest portion of the oval being in alignment with the handle.

13. A racket according to claim 1, wherein special zones are marked by lines on the net.

14. A racket as defined in claim 13, wherein one of the zones marked on the net is a power zone.

15. A racket as defined in claim 1, wherein the frame rim is colored with a fluorescent coloring.

16. A racket as defined in claim 1, wherein the stretch strips are colored with fluorescent coloring.

17. A racket according to claim 1, wherein a second net, in close proximity to the first net and supported by a separate set of self-holding adjustable stretch strips is held within the frame at a position such that it cooperates with the first net in propelling a ball.

18. A racket according to claim 1, wherein the end of the frame opposite to the end from which the handle extends is beveled.

19. A racket according to claim 1, wherein the end of the frame opposite to the end from which the handle extends is weighted.

* * * * *